United States Patent [19]

Perper

[11] 4,330,736

[45] May 18, 1982

[54] COMPENSATED CURRENT FEEDBACK OSCILLATOR BALLAST FOR FLUORESCENT LAMPS AND THE LIKE

[75] Inventor: Lloyd J. Perper, Tucson, Ariz.

[73] Assignee: Iota Engineering, Inc., Tucson, Ariz.

[21] Appl. No.: 157,879

[22] Filed: Jun. 9, 1980

Related U.S. Application Data

[63] Continuation-in-part of Ser. No. 26,094, Apr. 2, 1979, abandoned.

[51] Int. Cl.[3] ..... H05B 37/02; H05B 39/04; H05B 41/36

[52] U.S. Cl. ..... 315/209 R; 315/DIG. 5; 315/DIG. 7; 315/101; 315/206; 313/112

[58] Field of Search ..... 315/5, 3, 7, 205, 209, 315/DIG. 3, DIG. 5, DIG. 7, 101, 105, 106, 107, 279, 206; 331/112

[56] References Cited

U.S. PATENT DOCUMENTS

| | | | |
|---|---|---|---|
| 3,471,747 | 10/1969 | Gershen | 315/205 |
| 3,882,354 | 5/1975 | May | 315/DIG. 5 |
| 3,889,173 | 6/1975 | Klusmann et al. | 331/112 |
| 4,001,637 | 1/1977 | Gray | 315/205 |
| 4,005,335 | 1/1977 | Perper | 315/DIG. 7 |
| 4,103,209 | 7/1978 | Elms | 315/DIG. 7 |
| 4,104,715 | 8/1978 | Lawson, Jr. | 315/DIG. 5 |
| 4,150,323 | 4/1979 | Yeh et al. | 315/DIG. 5 |
| 4,183,080 | 1/1980 | Liebman | 331/112 |

*Primary Examiner*—Saxfield Chatmon, Jr.

[57] ABSTRACT

A power source for operating gas discharge lamps and other loads at high frequency, typically utilizing a dc source or a rectified ac source to produce a high frequency output. An inverter with oscillator circuit and first transformer has the secondary or load winding connected to a second transformer which provides a feedback signal to the transistor of the oscillator circuit through another transistor which functions as a variable resistance in the base drive of the oscillator transistor for maintaining power to the load substantially constant. A third winding on the inverter transformer is used to provide a control signal to the base circuit of the variable resistance for protecting the circuit components during an open secondary or no load condition.

27 Claims, 6 Drawing Figures

COMPENSATED CURRENT FEEDBACK OSCILLATOR BALLAST FOR FLUORESCENT LAMPS AND THE LIKE

CROSS REFERENCE TO RELATED APPLICATION

This application is a continuation-in-part of copending application U.S. Ser. No. 026,094 filed Apr. 2, 1979, now abandoned.

BACKGROUND OF THE INVENTION

This invention relates to a power source for gas discharge lamps and other loads operated at high frequency, typically power sources for driving fluorescent tube lamps from a dc supply or a standard 50 Hertz or 60 Hertz ac supply. Power sources of this general type are shown in U.S. Pat. Nos. 3,396,307; 3,889,153; 4,005,335; 4,017,785; and 4,127,797.

The present invention is directed to an improvement on that shown in U.S. Pat. No. 4,127,797, particularly the circuit of FIG. 7.

Efficiency of operation is a factor in most lighting systems, and it has been determined that better efficiency is obtained by operating the lamps or other load at a substantially constant power with changes in supply voltage and other parameters such as temperature, variations in load with change in temperature, variations in characteristics of circuit elements with temperature and time, and the like.

Accordingly it is an object of the present invention to provide a new and improved power source utilizing current feedback to produce substantially constant power output.

A problem is encountered in power sources utilizing current feedback such as in the aforesaid U.S. Pat. No. 4,127,797, under open circuit conditions when the output circuit wiring capacitance across the lamps is sufficient to maintain oscillation. When a lamp goes out or when there is some other malfunction in the output circuitry, there is an open circuit in the secondary side of the inverter transformer which can result in undesirably high voltages in the circuitry at the primary side of the transformer, and sometimes in permanent damage to circuit components.

It is another object of the present invention to provide a new and improved power source utilizing an inverter with current feedback and supplementary open circuit protection. Other objects, advantages, features and results will more fully appear in the course of the following description.

High power factor is an important factor in operation of lighting systems as well as other electrical systems from an AC supply. In operating a DC load from a rectified AC supply, a filter of some nature is utilized and better filtering is normally achieved at increased cost and size of the filter circuit.

It is another object of the present invention to provide a new and improved power source utilizing current feedback and operated in conjunction with a new and improved filter to obtain an increase in power factor.

SUMMARY OF THE INVENTION

The high frequency power source of the invention utilizes a conventional inverter with oscillator circuit and first transformer, with the oscillator circuit having a first transistor with its emitter and collector connected in series with the first transformer primary winding across a dc supply. The source includes a second transformer with a first winding connected in series with the secondary or load winding of the frist transformer, providing a current feedback for the inverter. A variable resistance circuit is connected in the drive circuit between the second winding of the second transformer and the base of the first transistor for changing the duty cyle or on and off time of the first transistor to thereby control the power at the secondary of the first transformer.

In one embodiment, a second transistor is connected in series in the base drive circuit of the first transistor and in a second embodiment, the second transistor is connected in parallel. In both instances, the second transistor serves as the variable resistance means in the base drive circuit of the first transistor.

Open circuit protection is achieved by adding another winding to the first transformer and connecting this winding into the base circuit of the second transistor with a voltage limiter such as zener diode so that this additional winding is effective only when the voltage thereacross exceeds a predetermined value.

In an alternative embodiment, increased power factor is achieved by combining a filter with the variable resistance feedback inverter, with the filter having an inductor and a diode in series at a junction and in parallel with another diode, with a capacitor connected at the junction.

DESCRIPTION OF THE PREFERRED EMBODIMENTS

Figure 1:
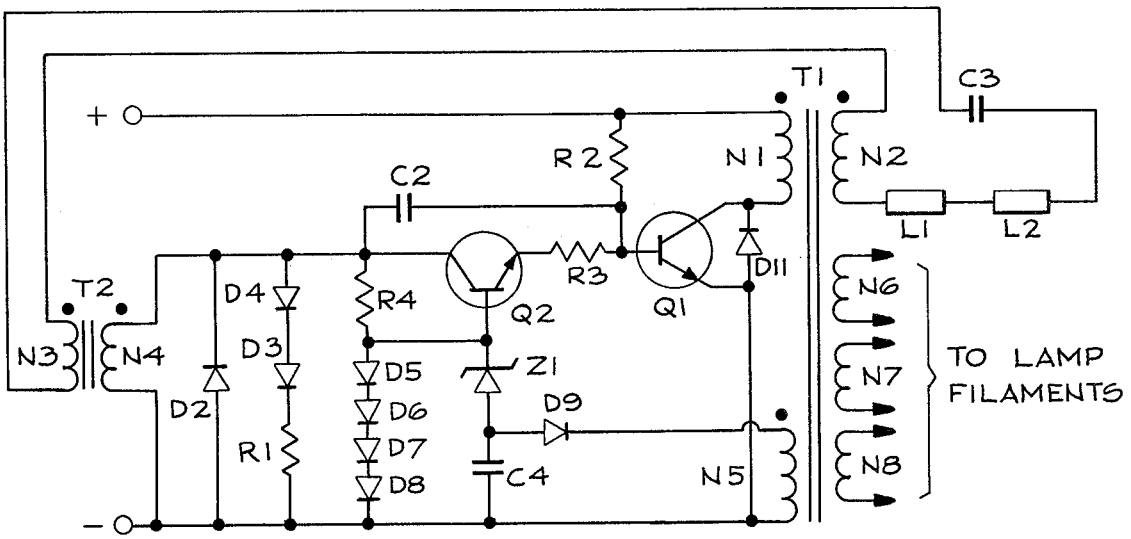
FIG. 1 is an electrical diagram of an inverter type power source incorporating the series configuration of the present invention.

The circuit of FIG. 1 utilizes a first transformer T1 and a second transformer T2. The transformer T1 has a primary winding N1 and a secondary winding N2. The transformer T2 has a first winding N3 and a second winding N4, with the first winding N3 connected in series with the secondary winding N2, fluorescent lamps L1, L2 and capacitor C3. The primary winding N1 is connected in series with the collector and emitter of transistor Q1 across the dc supply. A diode D11 may be connected across the emitter and collector if desired. A starter resistor R2 is connected between one terminal of the dc supply and the base of transistor Q1. A feedback circuit is connected between the winding N4 and the base of transistor Q1, and one such feedback circuit is shown in the aforementioned U.S. Pat. No. 4,127,797. Additional windings N6, N7, N8 may be provided on transformer T1 to provide filament power to lamps L1, L2. The circuit described thus far is conventional and its operation is well understood.

The feedback circuit of the invention includes transistor Q2 with its collector and emitter connected in series with resistor R3 between winding N4 and the base of transistor Q1. Capacitor C2 is connected in parallel with the series combination of transistor Q2 and resistor R3. Diode D2 is connected across winding N4. Resistor R1 and diode D3, D4 are connected in series across winding N4, with the diodes of a plurality opposite to that of didode D2. Resistor R4 and diodes D5, D6, D7 and D8 are connected in series across winding N4, functioning as a voltage divider, with the junction of resistor R4 and diode D5 connected to the base of transistor Q2.

An open circuit protection circuit may also be incorporated in the power source. A winding N5 on the transformer T1 is connected to the base of transistor Q2 through diode D9 and zener diode Z1, with capacitor C4 connected between the junction of diode D9 and zener Z1 and the other terminal of winding N5.

In operation, transistor Q2 and resistor R3 function as a series variable resistance (in parallel with C2) between the feedback winding N4 and the base of oscillator transistor Q1. Q2 acts to adjust the base drive of Q1 for improved constancy of lamp current, largely by control of the duty cycle (the fraction of each cycle during which the transistor conducts).

Diodes D5, D6, D7 and D8 and resistor R4 comprise a voltage divider producing a voltage at the base of Q2 which never exceeds the diode threshold (approx. 2.8 volts).

When the drive current to the base of Q1 increases, the voltage drop across R3 increases (as a result of the current through Q2, R3 and the base-to-emitter path of Q1). The emitter voltage of Q2 then rises, while the base voltage is held down to 2.8 volts by the diodes. As the emitter voltage approaches 2.8 volts, Q2 tends to cut off, holding down the current to the base Q1. As cutoff is approached, conduction by Q1 takes place over progressively less of the oscillator cycle, resulting in duty cycle control.

Diode D2 provides a load across winding N4 for negative voltage output, and D3, D4, R1 in series provide a load for positive output, where R1 permits sufficient positive excursion to actuate Q2. The loading reflects a low impedance into winding N3 so as to hold the voltage drop across N3, which is in series with the lamps, to a relatively low value.

The combination N5, D9, C4 provides a negative voltage to zener diode Z1 when the collector voltage swings positive. Z1 is sufficiently large (viz. order of 20 v.) that no current flows through it in normal operations. When open-circuit occurs, the voltage across N5 tends to consist of narrowed peaks of more than doubled amplitude, eg. 30 volt peaks. Z1 then conducts, holding the base of Q2 lower than 2.8 volts, and the collector voltage is reduced, typically from more than 600 volts to less than 400 volts. D9 blocks positive swings and C4 smooths the negative pulses.

Figure 2:
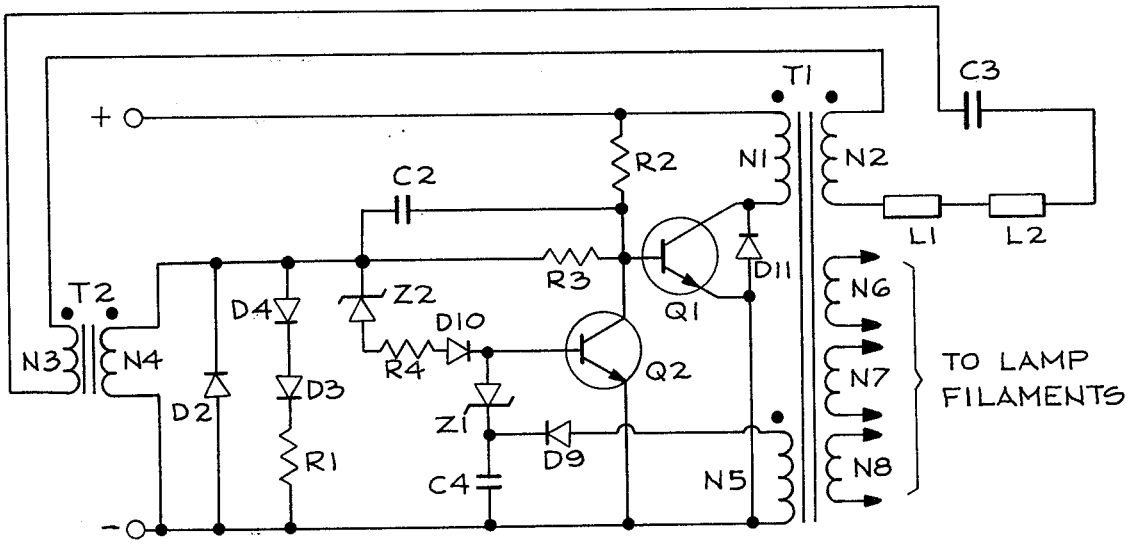
FIG. 2 is a similar electrical diagram incorporating a parallel configuration.

In the circuit of FIG. 1, transistor Q2 is in a series configuration. An alternative embodiment is shown in FIG. 2 with transistor Q2 in a parallel configuration. Resistor R3 is connected between the base of transistor Q1 and one terminal of winding N4. The collector and emitter of transistor Q2 are connected between the base of transistor Q1 and the other terminal of winding N4. The one terminal of winding N4 is connected to the base of transistor Q2 through zener diode Z2, resistor R4 and diode D10. As with the circuit of FIG. 1, winding N5 and associated components diode D9, zener diode Z1 and capacitor C4 may be used for reducing voltages in the primary side of transformer T1 when there is an open circuit in the secondary side.

In the circuit of FIG. 2, increasing voltage at the output of winding N4 (which occurs with increasing power output of transformer T1) drops through zener diode Z2, resistor R4, and diode D10, swinging the control transistor Q2 base positively at a threshold oscillation level, above which level Q2 conducts. As Q2 conducts, its collector-to-ground impedance diminishes, ultimately approximating that of a diode between the base of oscillator Q1 and ground, reducing the output level.

Similarly to the circuit of FIG. 1, the increasing output of coil N5 is rectified and caused to limit oscillations during open circuit, or with reduced loading. In the FIG. 2 circuit, however the mechanism differs in that the voltage applied to the base of Q2 is positive, causing conduction, (rather than negative, which increases the drive impedance on the series configuration). Above the threshold voltage set by zener diode Z1, a positive voltage is applied to the base of Q2, causing the emitter-to-base impedance to drop, reducing the base drive to Q1. This control action functions as an over-ride on the base signal at Q2 which is normally derived through Z2, R4 and D10.

The series and parallel control configurations of FIGS. 1 and 2, respectively are alternative methods of attaining amplitude control of oscillations under varying conditions, and are independently capable of exercising control. In the event that a closer control of amplitude and impedance levels is desired, it should be understood that the series and parallel configurations may be combined.

The non-linear operation provided by D2, D3, D4 and R1 is an important feature in maintaining power to the load substantially constant. The objective is to have relatively low voltage drop across winding N3 of transformer T2, which is effected by limiting the voltage swing across N4 by means of D2, D3, D4 and R1. If the voltage swing is not so limited, the power from winding N2 of T1 would be less completely delivered to the lamps. The positive-conducting branch D4, D3, R1 permits a large initial surge of charge to the base of transistor Q1, whose operation at first resembles that of a single diode, but whose voltage later rises until D4, D3, R1 tend to take over the circuit flow.

Figures 3, 4A, 4B, 4C:
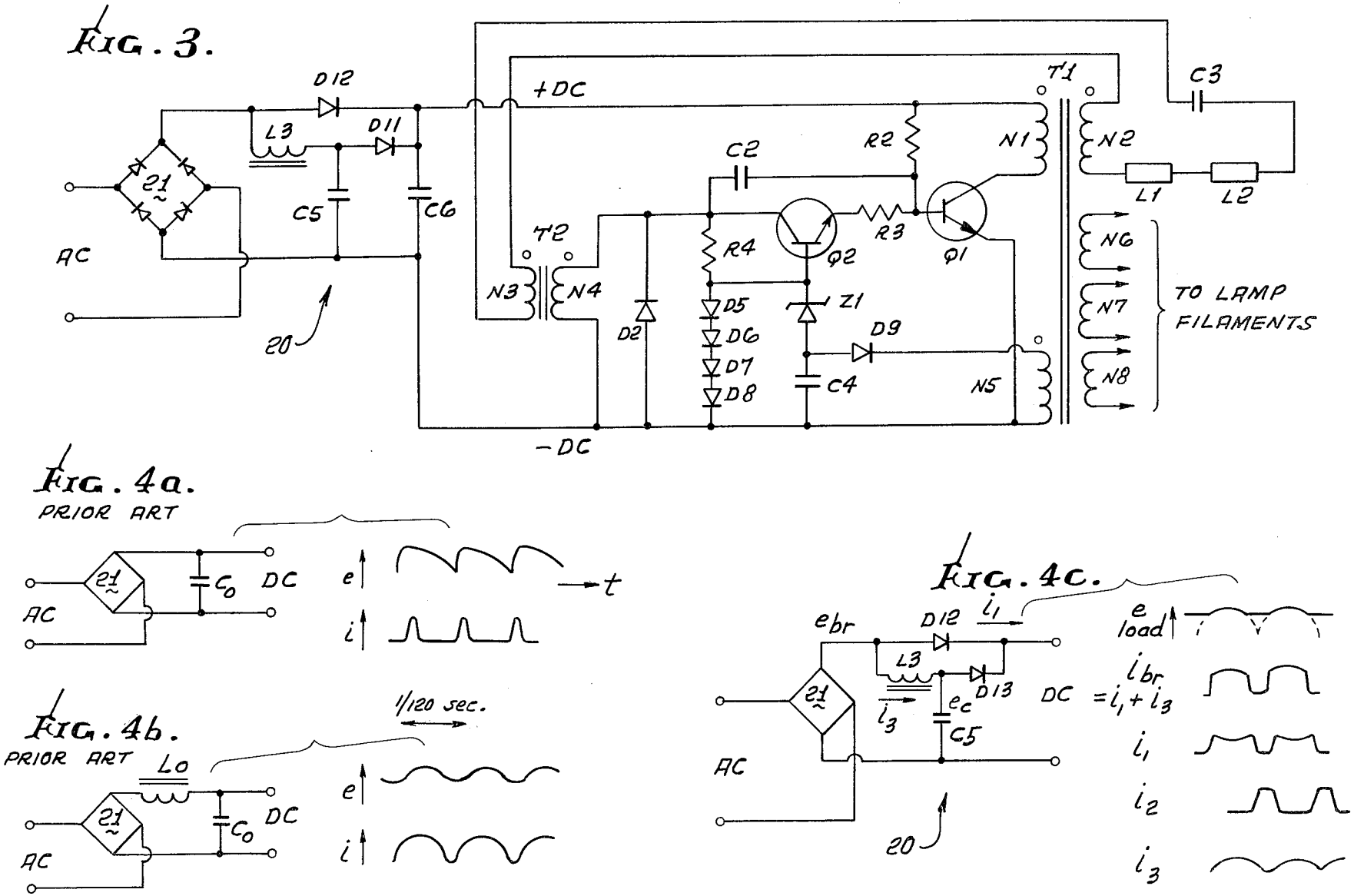
FIG. 4a. PRIOR ART
FIG. 4b. PRIOR ART
FIG. 3 is an electrical diagram of an alternative embodiment of the present invention providing improved power factor.
FIGS. 4*a*, 4*b* and 4*c* are diagrams illustrating three filter circuits and their operation.

In the alternative embodiment of FIG. 3, D4, D3 and R1 are omitted, giving transistor Q2 more control over transistor Q1, thereby improving the power factor of the circuit. This improved power factor is obtained in exchange for some loss in efficiency as transistor Q2 dissipates more power in this mode of operation.

In the circuit of FIG. 3, elements corresponding to those of FIGS. 1 and 2 are identified by the same reference numerals. A filter 20 is connected between a full wave rectifier 21 and the inverter circuit. The filter 10 includes diodes D12 and D13, choke L3 and capacitor C5. Capacitor C6 provides a feedback path for Q1. Typically C5 is 50 microfarads, C6 is 0.68 microfarads, D12 and D13 are 30 S4 diodes, and L3 is 0.2 henries and 0.2 ohms.

In conventional electronic ballast applications, a capacitor Co is located directly across the output terminals of a bridge rectifier 21 connected to the ac power line, as shown in FIG. 4*a*. The capacitor smooths the rectified output e, minimizing flicker of the driven lamps. However, the capacitor draws current i in short, high-amplitude bursts at twice the line frequency. These current pulses have a high rms value, with the effect that the power factor $$\left(\frac{\text{power}}{\text{rms voltage} \times \text{rms current}}\right)$$

is lowered, the line losses are increased, and the high-power-factor performance obtainable from magnetic ballasts is not met. Moreover, the pulsed current tends to reduce capacitor longevity.

A straightforward way to improve the power factor of such circuitry is to insert a series input inductance Lo, as shown in FIG. 4*b*. The buildup of current is more gradual than in the case of FIG. 4*a*, and the rms value of the capacitor charging current is reduced, permitting a higher power factor, and causing less reduction of the internal electro-mechanical forces which reduce operating life. However, a relatively large inductor is required to extend the current wave shape, with wire and core size sufficient to handle the full amount of current drawn by the inverter.

The filter 20 of FIG. 3 is shown in FIG. 4*c*. With this filter, a constant-power type ballast may be used., which will draw substantially constant power over a voltage input ratio of two or more. Provided that the input voltage is held within these limits, the light generated will be substantially constant.

Capacitor C5 charges to a certain voltage $e_c$. When the full-wave rectifier output voltage $e_{br}$ exceeds this value, current $i_1$ flows directly from the rectifier bridge to the load; when $e_{br}$ exceeds $e_c$, the capacitor C5 supplies current $i_2$ to the load. Charging of the capacitor occurs through inductor L3 with current $i_3$; the energy stored in the inductor also serves to deliver power to the load, as well as capacitive energy, when $e_{br}$ is less then $e_c$.

Typically, two-thirds of the energy from the bridge is supplied directly to the load via $i_1$. The remaining one-third is stored between L3 and C5, and is supplied to the load via $i_2$.

Representative values of L3 and C5 are 0.2 henry and 50 microfarads, respectively. With 120 v ac power at 60 Hz, these parameters will result in a power-factor of about 0.91 for a 75 watt load. The peak-to-peak current amplitude of $i_3$ may then be about 2 amperes, with an rms value on the order of 0.2 ampere. The lower rms current permits the use of an inductor L3 having less size and weight than that of Lo in FIG. 4*b*.

The open circuit protection achieved with Zener diode Z1, capacitor C4 and diode D9 is a desirable, but not essential portion of the circuits of FIGS. 1, 2 and 3.

I claim:

1. In a high frequency power source for a load such as gas discharge lamps, including an inverter with oscillator circuit and first transformer, said first transformer having primary and secondary windings, said oscillator circuit including a first transistor having base, emitter and collector, with said primary winding connected in series with said first transistor emitter and collector across a pair of dc input terminals, a second transformer having first and second windings, with said first winding connected in series with said secondary winding, and a starter resistor connected between the base of said first transistor and one of said input terminals across said primary winding.

the improvement comprising:

variable resistance means connected between said second winding and said first transistor base providing a drive circuit and responsive to variations in the power delivered to the load at said secondary winding for changing the on time of said first transistor.

2. A power source as defined in claim 1 wherein said variable resistance means includes a second transistor having base, emitter and collector, with the emitter and collector connected between said second winding and said first transistor base.

3. A power source as defined in claim 2 including a resistance-diode circuit connected between said second transistor base and said second winding and comprising a first voltage limiter diode, a first resistor and a second diode connected in series, with said first and second diodes connected with opposite polarities.

4. A power source as defined in claim 3 including third diode means of one polarity connected across said second winding, and fourth diode means of opposite polarity in series with a second resistor connected across said second winding.

5. A power source as defined in claim 4 including a capacitor and a third resistor connected in parallel with each other and between said second winding and said first transistor base.

6. A power source as defined in claim 2 including a third winding on said first transformer, and a voltage limiter diode connected between said third winding and said second transistor base.

7. A power source as defined in claim 6 including a capacitor and a second diode connected at a junction in series across said third winding, with said voltage limiter diode connected at the junction of said capacitor and second diode.

8. A power source as defined in claim 2 including a first resistor connected in series with said second transistor emitter and collector between said second winding and said first transistor base.

9. A power source as defined in claim 8 including a voltage divider connected across said second winding and having a second resistor connected in series with a diode means at a junction, with said junction connected to said second transistor base.

10. A power source as defined in claim 9 including a capacitor connected in parallel with said first resistor and second transistor emitter and collector.

11. A power source as defined in claim 2 with said second transistor emitter and collector connected between said first transistor base and one terminal of said second winding, and including a first resistor connected between said first transistor base and the other terminal of said second winding.

12. A power source as defined in claim 11 including a second resistor and a diode means connected in series between said second transistor base and said other terminal of said second winding.

13. A power source as defined in claim 12 wherein said diode means includes a first diode of one polarity and a voltage limiter diode of the opposite polarity.

14. A power source as defined in claim 13 including a capacitor connected in parallel with said first resistor.

15. A power source as defined in claim 1 including:

rectifier means providing a rectified DC voltage at first and second output terminals, a filter connected between said rectifier means first and second output terminals and first and second input terminals of said inverter, respectively, said filter comprising a first diode connected between said first output and input terminals, a choke and a second diode connected in series at a first junction and in parallel with said first diode with said choke connected to said first output terminal, a first capacitor connected between said first junction and said second output terminal, and a second capacitor connected across said first and second input terminals.

16. A power source as defined in claim 15 wherein said variable resistance means includes a second transistor having base, emitter and collector, with the emitter and collector connected between said second winding and said first transistor base.

17. A power source as defined in claim 16 including third diode means of one polarity connected across said second winding, and a third capacitor and a first resistor connected in parallel with each other and between said second winding and said first transistor base.

18. A power source as defined in claim 16 including a third winding on said first transformer, and a third voltage limiter diode connected between said third winding and said second transistor base.

19. A power source as defined in claim 18 including a fourth capacitor and a fourth diode connected at a second junction in series across said third winding, with said third voltage limiter diode connected at said second junction of said fourth capacitor and fourth diode.

20. A power source as defined in claim 16 including a first resistor connected in series with said second transistor emitter and collector between said second winding and said first transistor base.

21. A power source as defined in claim 20 including a voltage divider connected across said second winding and having a second resistor connected in series with a third diode means at a junction, with said junction connected to said second transistor base.

22. A power source as defined in claim 21 including a third capacitor connected in parallel with said first resistor and second transistor emitter and collector.

23. In a high frequency power source for a load such as gas discharge lamps, including an inverter with oscillator circuit and first transformer, said first transformer having primary and secondary windings, said oscillator circuit including a first transistor having base, emitter and collector, with said primary winding connected in series with said first transistor emitter and collector across a pair of dc input terminals, a second transformer having first and second windings, with said first winding connected in series with said secondary winding, and a starter resistor connected between the base of said first transistor and one of said input terminals across said primary winding, the improvement comprising:

a first resistor;

a second transistor having base, emitter and collector, with the emitter and collector connected in series with said first resistor between said second winding and said first transistor base providing a variable resistance responsive to variations in the power load at said secondary winding for changing the on time of said first transistor;

a second resistor and first diode means connected in series at a first junction and across said second winding, with said second transistor base connected to said first junction;

a first capacitor connected in parallel with said first resistor and second transistor between said second winding and said first transistor base;

a third winding on said first transformer;

a first voltage limiter diode; and a second capacitor and a second diode connected in series at a second junction and across said third winding, with said first limiter diode connected between said second transistor base and said second junction.

24. A power source as defined in claim 23 including third diode means of one polarity connected across said second winding, and fourth diode means of opposite polarity in series with a third resistor connected across said second winding.

25. In a high frequency power source for a load such as gas discharge lamps, including an inverter with oscillator circuit and first transformer, said first transformer having primary and secondary windings, said oscillator circuit including a first transistor having base, emitter and collector, with said primary winding connected in series with said first transistor emitter and collector across a pair of dc input terminals, a second transformer having first and second windings, with said first winding connected in series with said secondary winding, and with said second winding having first and second terminals, and a starter resistor connected between the base of said first transistor and one of said input terminals across said primary winding, the improvement comprising:

a first resistor and a first capacitor connected in parallel between said first transistor base and said first terminal of said second winding;

a second transistor having base, emitter and collector, with the emitter and collector connected between said second terminal of said second winding and said first transistor base;

a first diode of one polarity, a second resistor, and a second voltage limiter diode of the opposite polarity connected in series and between said second transistor base and said first terminal of said second winding;

a third winding on said first transformer;

a third voltage limiter diode; and a second capacitor and a third diode connected in series across said third winding, with said second limiter diode connected at the junction of said second capacitor and third diode.

26. A power source as defined in claim 25 including fourth diode means of one polarity connected across said second winding, and fifth diode means of opposite polarity in series with a third resistor connected across said second winding.

27. In a high frequency power source for a load such as gas discharge lamps, including an inverter with oscillator circuit and first transformer, said first transformer having primary and secondary windings, said oscillator circuit including a first transistor having base, emitter and collector, with said primary winding connected in series with said first transistor emitter and collector across a pair of dc input terminals, a second transformer having first and second windings, with said first winding connected in series with said secondary winding, and a starter resistor connected between the base of said first transistor and one of said input terminals across said primary winding, the improvement comprising:

a first resistor;

a second transistor having base, emitter and collector, with the emitter and collector connected in series with said first resistor between said second winding and said first transistor base providing a variable resistance responsive to variations in the power load at said secondary winding for changing the on time of said first transistor;

a second resistor and first diode means connected in series at a first junction and across said second winding, with said second transistor base connected to said first junction;

a first capacitor connected in parallel with said first resistor and second transistor between said second winding and said first transistor base;

second diode means connected across said second winding with polarity opposite that of said first diode means;

rectifier means providing a rectified DC voltage at first and second output terminals; and a filter connected between said rectifier means first and second output terminals and first and second input terminals of said inverter, respectively, said filter comprising a third diode connected between said first output and input terminals, a choke and a fourth diode connected in series at a second junction and in parallel with said first diode with said choke connected to said first output terminal, a second capacitor connected between said second junction and said second output terminal, and a third capacitor connected across said first and second input terminals.

* * * * *